United States Patent [19]

Stater

[11] Patent Number: 4,958,833

[45] Date of Patent: Sep. 25, 1990

[54] APPARATUS FOR ADJUSTING THE RESTING HEIGHTS OF FREE-MOVING BARBELLS ON WEIGHT-TRAINING RACKS OR STANDS

[76] Inventor: Vernon L. Stater, 1140 Kimberly Pl., Redlands, Calif. 92373

[21] Appl. No.: 264,144

[22] Filed: Oct. 28, 1988

[51] Int. Cl.[5] ..... A63B 21/072

[52] U.S. Cl. ..... 272/123

[58] Field of Search ..... 272/93, 103, 109, 117, 272/118, 123, 134, DIG. 4, 62, 70.2, 110; 248/224.4; 211/57.1, 59.1; 116/173

[56] References Cited

U.S. PATENT DOCUMENTS

| | | | |
|---|---|---|---|
| 855,994 | 6/1907 | Sorrell | 272/70.2 X |
| 1,348,110 | 7/1920 | Hasskarl | 272/70.2 |
| 1,679,168 | 7/1928 | O'Brien | 272/70.2 |
| 2,172,645 | 9/1939 | Taylor | 272/70.2 |
| 2,410,582 | 11/1946 | Higgins | 272/70.2 X |
| 2,682,956 | 7/1954 | Pike | 211/59.1 X |
| 3,162,409 | 12/1964 | Straayer et al. | 116/173 |
| 3,207,511 | 9/1965 | Hoffman | 272/117 X |
| 3,250,532 | 5/1966 | Brown | 272/110 |
| 4,201,380 | 5/1980 | Birch | 272/117 |
| 4,302,009 | 11/1981 | Johnson | 272/123 |
| 4,319,747 | 3/1982 | Rogers . | |
| 4,360,198 | 11/1982 | Waulters | 272/117 |
| 4,441,706 | 4/1984 | Korzaniewski | 272/118 |
| 4,485,929 | 12/1984 | Betts, Sr. | 211/59.1 X |
| 4,527,797 | 7/1985 | Slade, Jr. et al. | 272/118 X |
| 4,564,194 | 1/1986 | Dawson | 272/123 |
| 4,700,944 | 10/1987 | Sterba et al. | 272/123 X |
| 4,729,561 | 3/1988 | Desjardins | 272/117 |
| 4,781,374 | 11/1988 | Lederman | 272/123 X |

FOREIGN PATENT DOCUMENTS

| | | | |
|---|---|---|---|
| 456790 | 3/1928 | Fed. Rep. of Germany | 272/123 |

OTHER PUBLICATIONS

Advertisement by Marcy Gymnasium Equipment Co. in Athletic Digest, Mar. 1980, the "Venus Power Rack" in the Atlantic Fitness Products Catalog, Nov. 1985.
Universal Gym Equipment, Inc. 1987 Catalog, p. 5.
Champion Barbell Company 1988 Catalog, pp. 14–15.
Buckeye Barbell, Inc.'s Catalog, Date Unknown.
Muscle and Fitness Magazine, Date Unknown.

*Primary Examiner*—Robert W. Bahr
*Attorney, Agent, or Firm*—Lyon & Lyon

[57] ABSTRACT

An apparatus for adjusting the rest height of free-moving barbells in which a support plug is slidably inserted into one of several angled pockets in the upright standards of the weight-training rack or stand. The barbell used in the exercise rests upon the extended portion of the support plug in each upright standard and the rest height of the barbell can be varied by choosing one of several available pockets for containing the support plug in each upright support.

2 Claims, 1 Drawing Sheet

APPARATUS FOR ADJUSTING THE RESTING HEIGHTS OF FREE-MOVING BARBELLS ON WEIGHT-TRAINING RACKS OR STANDS

BACKGROUND OF THE INVENTION

The field of the present invention is weight-training equipment.

Weight-training equipment, particularly equipment utilizing a free-moving barbell physically unconnected to a rack or stand, must be adjustable for users of differing heights. For instance, a bench-press free-weight rack or stand involving a barbell which exercises the chest muscles must have a resting height which is adjustable for users having arms of differing lengths. Similarly, a squat rack utilizing a barbell which is placed behind a user's head must have a resting height which is adjustable for users having differing heights.

Typical of methods used in the art to solve the problem of adjustable resting heights of free-moving barbells are to be found in U.S. Pat. Nos. 4,201,380 and 4,302,009. In '380 the upright standards used to support a barbell have cut-outs spaced throughout the working height of the standards. At rest, the barbell may be placed in the appropriate cut-out. Similarly, '009 discloses a method of height adjustability whereby the standards contain short metal plates welded to each standard and spaced along its length to support the barbell. Each method, however, possesses a major drawback. In '380, the user or assistant must guide the barbell into a supporting cut-out in the standard at the end of the exercise. This action requires a degree of strength and dexterity not always possessed by a user at the end of an exercise. In '009, the projections from the standards above and below the selected projection tend to interfere with the movement of the exercise. Thus, there is a need in the art for an adjustable-height support for barbells in which there is no interference with the range of motion of the user in any particular exercise and which still possesses the capability of catching a falling barbell at the end of the exercise.

SUMMARY OF THE INVENTION

The present invention is directed at an apparatus for adjusting free-moving barbells in which the barbell is securely supported in upright standards by metal support plugs which slidably fit into upwardly-angled holes in the standards. The apparatus contemplated provides simple resting height adjustment and facile placement of the barbell on the stand.

In a first aspect of the present invention, the resting height of the barbell can be varied by choosing one of the several available positions to contain the support plug in each upright standard. The positions and the support plugs which are inserted therein are angled upwardly in order to keep the support plugs within the selected positions and to keep the barbell from rolling off the support plugs when at rest. In addition, the single protrusion allows the user to guide the weight precisely to a resting place when it is above the support plug without the need to precisely locate a notch. In order to facilitate ease of adjustability, the protruding support plugs may be easily moved from position to position by one person by lifting each end of the barbell serially as the plugs are moved into the appropriate position.

Accordingly, it is an object of the present invention to improve the ease of adjustability of free-moving barbells While reducing the interference the supporting structure could have upon the range of motion in the user's weight-training exercise and without sacrificing the inherent safety associated with using protruding plugs for support of the barbell. Other and further objects and advantages will appear hereinafter.

DETAILED DESCRIPTIONS OF THE PREFERRED EMBODIMENT

The apparatus described here for adjusting free-weight barbells is applicable to any device which uses a barbell and upright standards. The most common examples of these devices are the bench press, incline bench press, decline bench press, overhead or vertical press, and the squat rack, but the invention is not limited to these applications.

Figure 1:
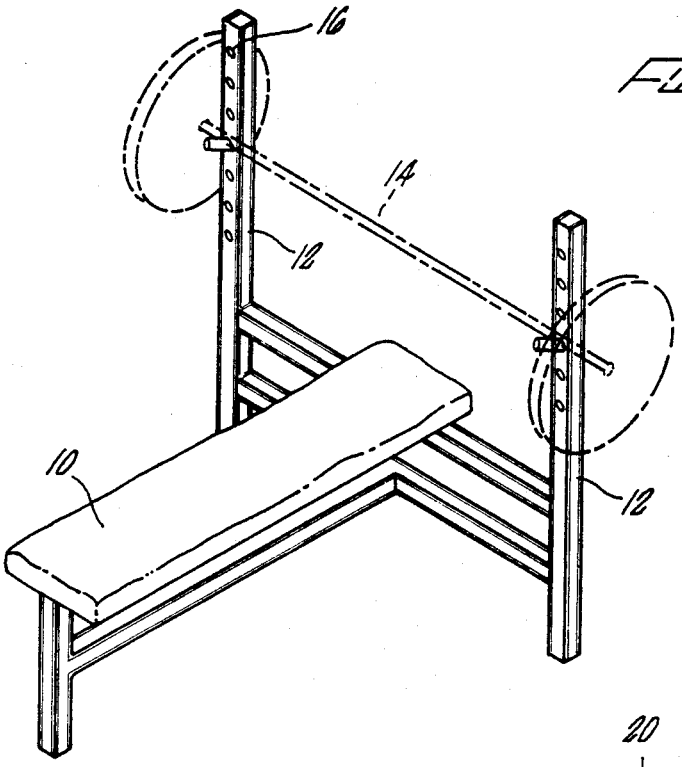
FIG. 1 is a perspective view of the invention as implemented on a typical bench-press weight-training rack or stand.
Figure 2:
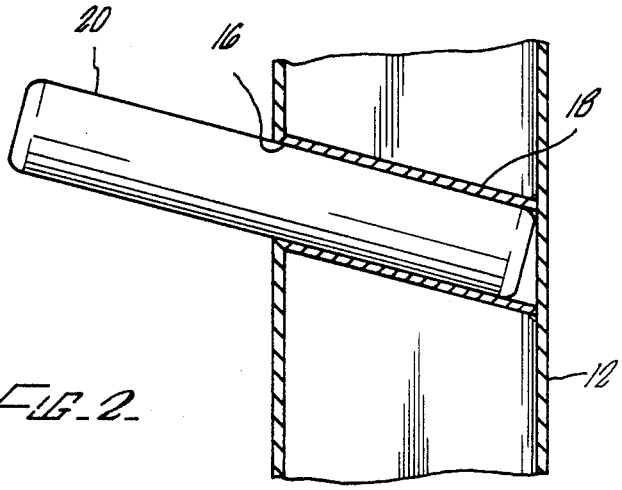
FIG. 2 is a cross-sectional view of a preferred embodiment of the invention in which a support plug rests in an available pocket in an upright standard of a weight-training rack or stand.

The apparatus comprising the invention typically includes a bench 10, which may or may not be connected to two associated upright standards 12. The upright standards 12 are positioned adjacent to the bench 10 in such a way that the user lying upon the bench 10 can easily and effectively grasp the barbell 14 supported by the upright standards 12. The resting height of the barbell 14 must be varied according to the arm length of the user. As shown in FIGS. 1 and 2, in the preferred embodiment each upright standard 12 contains at least one hole 16, approximately 1 inch in diameter, with each hole 16 facing the user. The greater the number of holes 16 located along the vertical height of the upright standard 12, the wider the range of height adjustability. Welded behind each hole 16, and contained within the structure of the upright standard 12, is a hollow metal pocket 18, approximately three inches deep. The pocket 18 is angled upward at some angle above the horizontal. A solid metal support plug 20, approximately six inches long, slidably fits partially within the pocket 18 s that the plug 20 is supported by the pocket 18 and also extends outward and upward.

The plug 20 supports the barbell 14 which is to be lifted in exercises performed by the user. Only one plug 20 is required in each upright standard 12, since each plug 20 can be inserted into one of several available pockets 18 in order to vary the resting height of the barbell. The plug 20 is prevented from inadvertently falling out of the pocket 18 by the upward angle of the orientation of the pocket 18 containing it. The upward angle of the pocket 18 and plug 20 also prevents the barbell 14 from rolling off its support and falling upon the user. The finite depth of the three-inch deep pocket 18 prevents the plug 20 from sliding in too deep to support the barbell 14.

Figure 3:
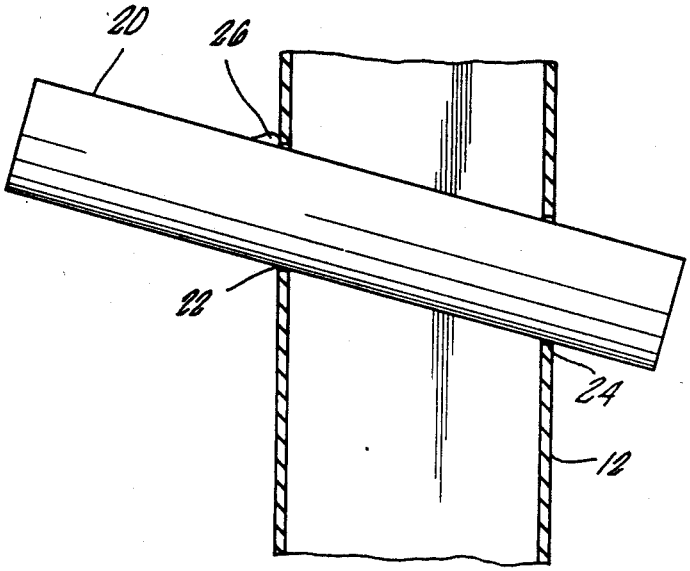
FIG. 3 is a cross-sectional view of an alternate embodiment of the invention in which a support plug passes through a pair of holes in an upright standard.

In another embodiment of the invention as shown in FIG. 3, the metal support plug 20 is approximately seven inches long and slidably extends through a pair of staggered holes 22 and 24 in each hollow upright standard 12. The pocket 18 of the preferred embodiment is absent, and the upward angle of the support plug 20 is provided by the staggered vertical spacing of the holes 22 and 24. Hole 22 in each pair of staggered holes 22 and 24 is located on the side of the upright standard 12 facing the user. Hole 24 in each pair of staggered holes 22 and 24 is located on the side of the upright standard 12 facing away from the user. Hole 22 is located somewhat vertically higher than hole 24, causing any support plug 20 passing through both holes 22 and 24 to be angled upward toward the user. The support plug 20 is prevented from sliding downward through holes 22 and 24 by a interference between a welded bead 26 located intermediate along the length of the support plug 20 which does not fit within the circumference of hole 22.

The method of barbell adjustability for the alternate embodiment is the same as for the preferred embodiment described above.

While embodiments and applications of this invention have been shown and described, it would be apparent to those skilled in the art that many more modifications are possible without departing from the inventive concepts herein. The invention, therefore, is not to be restricted except in the spirit of the

What is claimed is:

1. A device for adjusting the rest height of upright standards in a weight-training rack or stand utilizing a free-moving barbell, comprising:

a weight-training rack or stand with associated upright standards for supporting a free-moving barbell;

support plugs;

at least one hole in each upright standard into which a said support plug slidably fits; and means for retaining said plugs in said standards to support said barbell including pockets located within said standards and behind said holes, said support plugs being slidably positionable in said pockets and extending outwardly of said pockets when positioned therein to support said barbell, said pockets and said support plugs slidably positionable therein being both angled such that the angle formed by the intersection of each said upright standard and the extended portion of each said support plug is less than 90°.

2. A device for adjusting the rest height of upright standards in a weight-training rack or stand utilizing a freemoving barbell, comprising:

a weight-training rack or stand with associated upright standards for supporting a free-moving barbell;

support plugs;

at least one hole in each upright standard into which a said support plug slidably fits;

means for retaining said plugs in said standards to support said barbell including pockets located within said standards and behind said holes, said support plugs being slidably positionable in said pockets and extending outwardly of said pockets and angled upwardly when positioned therein to support said barbell; and a free-moving barbell selectively positionable on said support plugs.

* * * * *